US012024384B2

(12) United States Patent
Yoshida

(10) Patent No.: US 12,024,384 B2
(45) Date of Patent: Jul. 2, 2024

(54) SHEET CONVEYING DEVICE, IMAGE FORMING APPARATUS

(71) Applicant: KYOCERA Document Solutions Inc., Osaka (JP)

(72) Inventor: Takeshi Yoshida, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 243 days.

(21) Appl. No.: 17/869,546

(22) Filed: Jul. 20, 2022

(65) Prior Publication Data

US 2023/0023244 A1 Jan. 26, 2023

(30) Foreign Application Priority Data

Jul. 21, 2021 (JP) ..... 2021-120286

(51) Int. Cl.
*B65H 3/06* (2006.01)
*B65H 5/06* (2006.01)

(52) U.S. Cl.
CPC ..... *B65H 3/06* (2013.01); *B65H 3/0684* (2013.01); *B65H 5/062* (2013.01); *B65H 2402/31* (2013.01); *B65H 2402/32* (2013.01); *B65H 2402/441* (2013.01); *B65H 2402/52* (2013.01); *B65H 2601/321* (2013.01); *B65H 2601/324* (2013.01); *B65H 2801/06* (2013.01)

(58) Field of Classification Search
CPC .... B65H 3/06; B65H 3/0684; B65H 2402/30; B65H 2402/31; B65H 2402/32; B65H 2402/441; B65H 2402/52; B65H 2404/152; B65H 2404/1521; B65H 2404/1522; B65H 2404/17; B65H 2601/321; B65H 2601/324
See application file for complete search history.

(56) References Cited

U.S. PATENT DOCUMENTS

2007/0145666 A1* 6/2007 Nishikata ..... B65H 3/0638 271/18
2008/0012204 A1* 1/2008 Wang ..... B65H 3/0676 271/121
2017/0088373 A1* 3/2017 Tahara ..... B65H 3/0684
2017/0131674 A1* 5/2017 Tomoe ..... B65H 3/0684
2018/0127223 A1* 5/2018 Horita ..... B65H 3/68

FOREIGN PATENT DOCUMENTS

JP 2019059559 A 4/2019

* cited by examiner

*Primary Examiner* — Prasad V Gokhale
(74) *Attorney, Agent, or Firm* — Alleman Hall & Tuttle LLP

(57) ABSTRACT

A rotating body unit includes a pair of bearing portions and a first engagement portion. A pair of bearing support members support the bearing portions when at support positions, and release the bearing portions when at retraction positions. An auxiliary tool includes a pair of arm portions and a second engagement portion. When the auxiliary tool is engaged with the rotating body unit mounted in the mounting portion, the arm portions abut on and move the bearing support members from the support positions to the retraction positions. The second engagement portion engages with the first engagement portion after the bearing support members move to the retraction positions. As the auxiliary tool is separated from the mounting portion with the second engagement portion engaging with the first engagement portion, the rotating body unit is pulled out of the mounting space integrally with the auxiliary tool.

10 Claims, 10 Drawing Sheets

SHEET CONVEYING DEVICE, IMAGE FORMING APPARATUS

INCORPORATION BY REFERENCE

This application is based upon and claims the benefit of priority from the corresponding Japanese Patent Application No. 2021-120286 filed on Jul. 21, 2021, the entire contents of which are incorporated herein by reference.

BACKGROUND

The present disclosure relates to a sheet conveying device provided with a rotating body unit including a rotating body that conveys sheets to a conveyance path and relates to an image forming apparatus.

An image forming apparatus is provided with a sheet conveying device and a printing device. The sheet conveying device conveys sheets placed on a sheet placement portion to a conveyance path inside the main body and then conveys the sheets along the conveyance path. The printing device forms images on the sheets conveyed along the conveyance path.

The sheet conveying device is provided with a pickup roller and a feed roller that rotate while in contact with the sheets. The pickup roller and the feed roller convey the sheets placed on the sheet placement portion to the conveyance path.

The pickup roller and the feed roller are consumables that degrade due to adhesion of paper dust or wear. Accordingly, it is desirable that the pickup roller and the feed roller can be removed from and installed in the main body by users.

For example, the pickup roller and the feed roller may be provided as a rotating body unit that is removably mounted in the main body.

The rotating body unit is provided with the pickup roller, the feed roller, and a frame body. The pickup roller and the feed roller are rotatably supported by the frame body.

SUMMARY

A sheet conveying device according to an aspect of the present disclosure includes a housing, a sheet feed portion, and an auxiliary tool. The sheet feed portion feeds a sheet placed on a sheet placement portion to a conveyance path. The sheet feed portion includes a mounting portion disposed in the housing and a rotating body unit mountable in the mounting portion. The auxiliary tool is capable of removing the rotating body unit from the mounting portion by being engaged with the rotating body unit. The rotating body unit includes a rotating body with a rotation shaft and a frame body supporting the rotating body and is mountable in the mounting portion in a mounting direction intersecting a width direction along the rotation shaft. The frame body includes a pair of sidewalls, a pair of bearing portions, and a first engagement portion. The pair of sidewalls face each other in the width direction. The pair of bearing portions protrude outward from the pair of sidewalls in the width direction and support both ends of the rotation shaft such that the rotation shaft can rotate. The first engagement portion is engageable with a part of the auxiliary tool. The mounting portion includes a pair of opposing walls, a mounting space, a pair of bearing support members, and a pair of biasing members. The pair of opposing walls face each other in the width direction. The mounting space is formed between the pair of opposing walls. The pair of bearing support members are supported by the pair of opposing walls to be movable in the width direction. The pair of biasing members bias the pair of bearing support members inward in the width direction. When located at support positions inside the pair of opposing walls, the pair of bearing support members can support the pair of bearing portions, and when located at retraction positions outside the support positions along the width direction, the pair of bearing support members can release the pair of bearing portions. The auxiliary tool includes a base portion, a pair of arm portions, and a second engagement portion. The pair of arm portions extend parallel to each other from the base portion with a space corresponding to a space between the pair of bearing support members therebetween. The second engagement portion is disposed in the base portion between the pair of arm portions and is engageable with the first engagement portion. When the auxiliary tool is engaged with the rotating body unit mounted in the mounting portion, the pair of arm portions abut on the pair of bearing support members and move the pair of bearing support members from the support positions to the retraction positions. The second engagement portion engages with the first engagement portion after the pair of bearing support members move to the retraction positions. As the auxiliary tool is separated from the mounting portion with the second engagement portion engaging with the first engagement portion, the rotating body unit is pulled out of the mounting space integrally with the auxiliary tool.

An image forming apparatus according to another aspect of the present disclosure is provided with the sheet conveying device and a printing device. The printing device forms an image on a sheet conveyed by the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes embodiments of the present disclosure with reference to the accompanying drawings. It should be noted that the following embodiments are examples of specific embodiments of the present disclosure and should not limit the technical scope of the present disclosure.

First Embodiment: Configuration of Image Forming Apparatus 10

Figure 1:
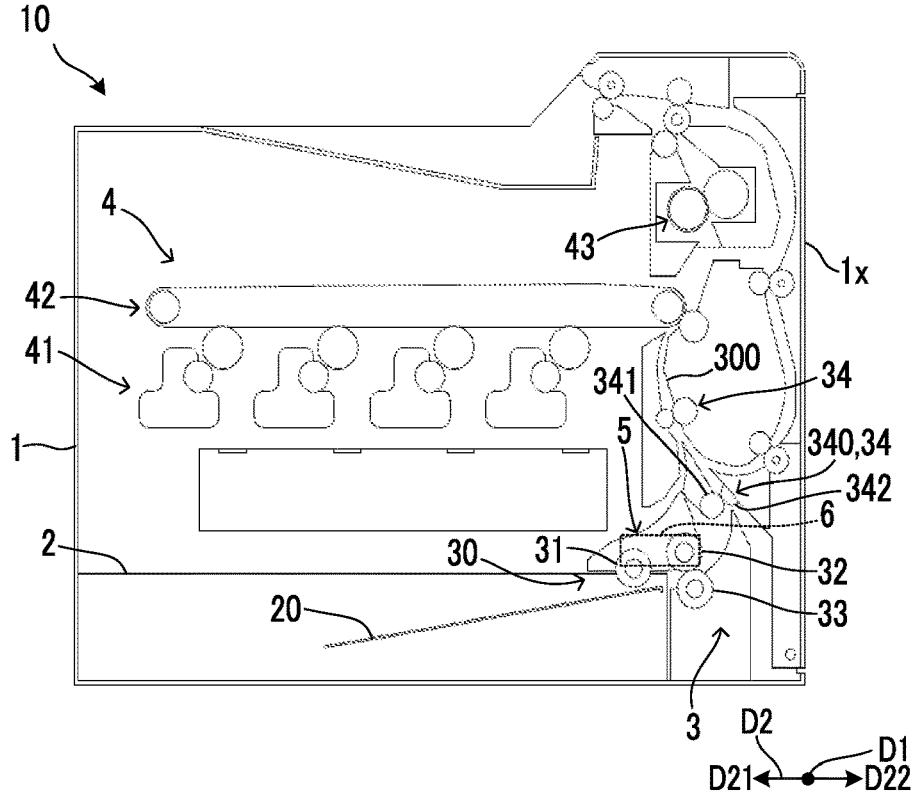
FIG. 1 is a configuration diagram of an image forming apparatus provided with a sheet conveying device according to a first embodiment.

As shown in FIG. 1, a sheet conveying device 3 according to a first embodiment constitutes a part of an image forming apparatus 10.

The image forming apparatus 10 is provided with a sheet storing portion 2, the sheet conveying device 3, and a printing device 4. The sheet conveying device 3 and the printing device 4 are housed inside a main body 1. The main body 1 is a housing that houses the sheet conveying device 3 and the printing device 4.

The sheet storing portion 2 is provided with a sheet placement portion 20 on which multiple sheets can be placed. The sheet conveying device 3 conveys the sheets placed on the sheet placement portion 20 to a conveyance path 300 inside the main body 1. Furthermore, the sheet conveying device 3 conveys the sheets along the conveyance path 300.

The sheet conveying device 3 is provided with a sheet feed portion 30 and multiple pairs of conveying rollers 34 disposed inside the main body 1. The sheet feed portion 30 feeds the sheets placed on the sheet placement portion 20 to the conveyance path 300.

The sheet feed portion 30 includes a pickup roller 31, a feed roller 32, and a separation roller 33. The multiple pairs of conveying rollers 34 include a pair of lead-in rollers 340.

The pickup roller 31 rotates while in contact with the top surface of the topmost sheet placed on the sheet placement portion 20. This causes the pickup roller 31 to send the sheet from the sheet placement portion 20 to the feed roller 32.

The feed roller 32 is in contact with the separation roller 33. The feed roller 32 comes into contact with the top surface of the sheet sent by the pickup roller 31 while rotating. This causes the feed roller 32 to send the sheet to the conveyance path 300.

In a case where multiple sheets are sent by the pickup roller 31, the separation roller 33 stops one or more sheets, in the multiple sheets, that are not in contact with the feed roller 32. Thus, the pickup roller 31, the feed roller 32, and the separation roller 33 feed the sheets placed on the sheet placement portion 20 one by one to the conveyance path 300.

It is noted that the pickup roller 31 and the feed roller 32 are examples of a rotating body that coveys the sheets placed on the sheet placement portion 20 to the conveyance path 300 inside the main body 1.

The multiple pairs of conveying rollers 34 rotate to convey the sheets along the conveyance path 300. The pair of lead-in rollers 340 take over the conveyance of the sheets from the feed roller 32. The pair of lead-in rollers 340 include a first lead-in roller 341 and a second lead-in roller 342 (see FIGS. 1 and 2).

The printing device 4 executes a printing process to form images on the sheets conveyed by the sheet conveying device 3. In the example shown in FIG. 1, the printing device 4 executes the printing process by an electrophotographic method.

To do so, the printing device 4 is provided with image creating devices 41, a transfer device 42, and a fixing device 43. The image creating devices 41 create toner images. The transfer device 42 transfers the toner images to the sheets. The fixing device 43 heats and pressurizes the toner images on the sheets to fix the toner images onto the sheets.

The printing device 4 may execute the printing process by another method such as an inkjet printing method.

The pickup roller 31 and the feed roller 32 are consumables that degrade due to adhesion of paper dust or wear. Accordingly, it is desirable that the pickup roller 31 and the feed roller 32 can be removed from and installed in the main body 1 by users.

The sheet conveying device 3 is provided with the pickup roller 31 and the feed roller 32 as a roller unit 5. The roller unit 5 is removably mounted in the main body 1. The roller unit 5 is an example of a rotating body unit.

The sheet feed portion 30 is provided with a mounting portion 6 and the roller unit 5. The mounting portion 6 is attached to the main body 1. The roller unit 5 is mounted in the mounting portion 6 (see FIGS. 1 to 3).

Figure 4:
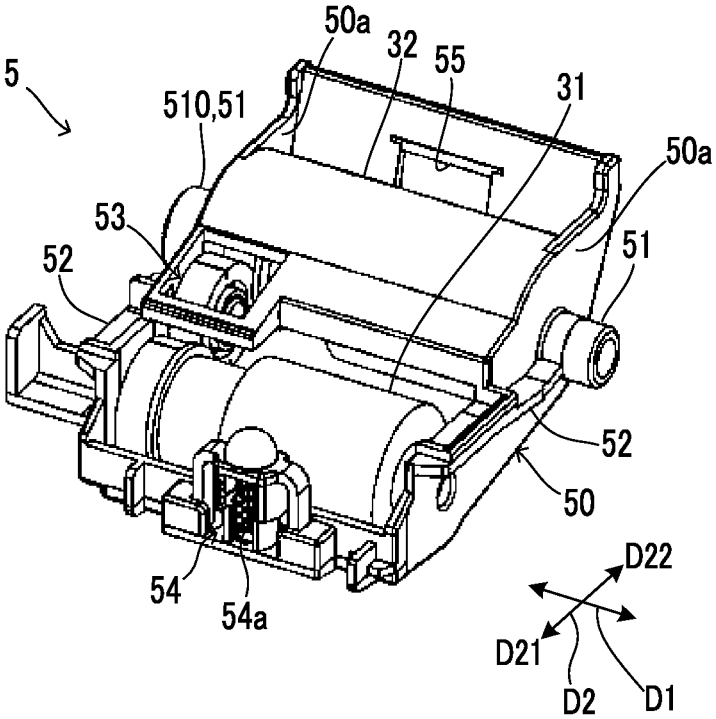
FIG. 4 is a first perspective view of the roller unit in the sheet conveying device according to the first embodiment.
Figure 5:
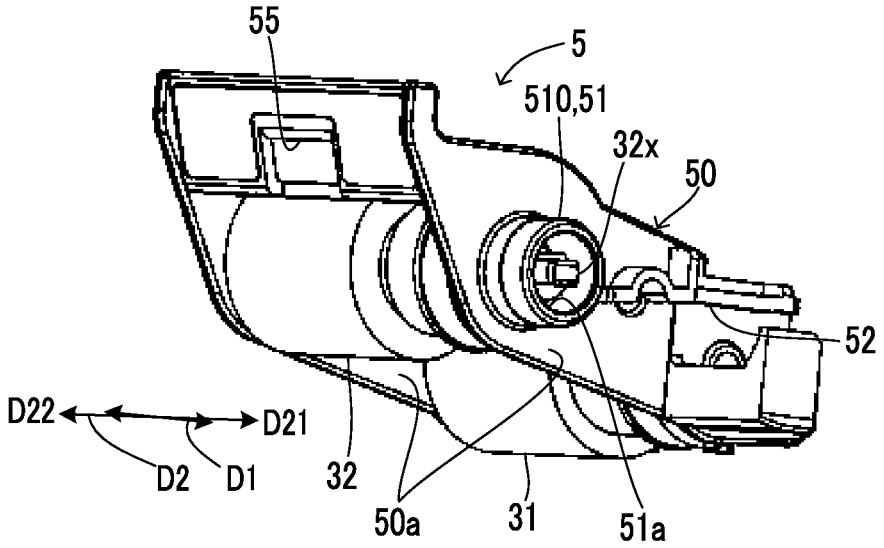
FIG. 5 is a second perspective view of the roller unit in the sheet conveying device according to the first embodiment.

As shown in FIGS. 4 and 5, the roller unit 5 is provided with the pickup roller 31, the feed roller 32, and a frame body 50. The pickup roller 31 and the feed roller 32 are rotatably supported by the frame body 50. For example, the frame body 50 is a member formed from synthetic resin.

Figure 2:
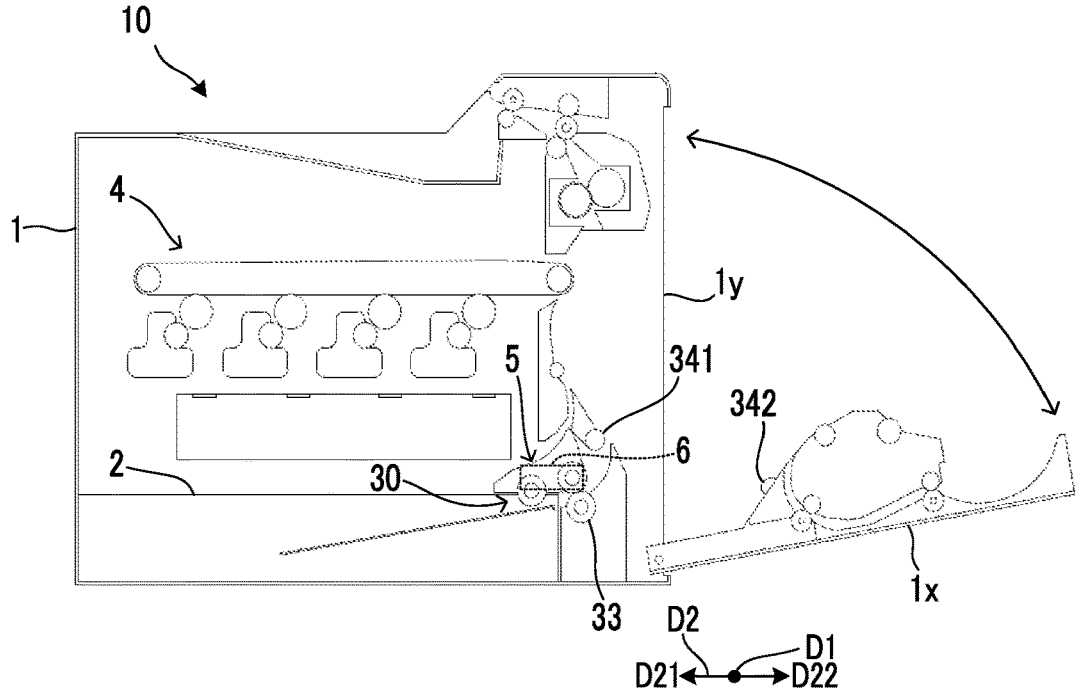
FIG. 2 shows the image forming apparatus with its rear cover open.

The image forming apparatus 10 is further provided with a rear cover 1*x* that can open and close an opening 1*y* created in the rear of the main body 1 (see FIGS. 1 and 2). The roller unit 5 is exposed through the opening 1*y* in the main body 1 when the rear cover 1*x* is open.

The roller unit 5 can be mounted in and removed from the mounting portion 6 while the rear cover 1*x* is open.

As shown in FIG. 2, the first lead-in roller 341 is supported by the main body 1, whereas the second lead-in roller 342 is supported by the rear cover 1*x*. Accordingly, opening the rear cover 1*x* causes the second lead-in roller 342 to be separated from the first lead-in roller 341.

The mounting of the roller unit 5 in the main body 1 may involve moving the roller unit 5 in multiple directions. In this case, users need to understand the procedure of moving the roller unit 5 in multiple directions in advance by, for example, reading user manuals.

The mounting is desirably as simple as possible. For example, the mounting may be an operation of only moving the roller unit 5 in one direction toward the main body 1. In this case, the users can mount the roller unit 5 in the main body 1 with intuitive operation.

In the sheet conveying device 3, the roller unit 5 and the mounting portion 6 have configurations that allow the roller unit 5 to be mounted in the main body 1 with operations as simple as possible. The following describes the configurations thereof.

In the drawings, a width direction D1 is parallel to the rotation shafts of the pickup roller 31 and the feed roller 32. The width direction D1 is also parallel to the rotation shafts of the multiple pairs of conveying rollers 34. In addition, in the drawings, a crossing direction D2 is a predetermined direction that intersects with the width direction D1.

The roller unit 5 is mounted in the mounting portion 6 in the crossing direction D2. Furthermore, the roller unit 5 is removed from the mounting portion 6 in the crossing direction D2.

In the drawings, a mounting direction D21 points to the inside of the main body 1 from outside in the crossing direction D2. In the drawings, a removal direction D22 points to the outside of the main body 1 from inside in the crossing direction D2.

The frame body 50 of the roller unit 5 includes a pair of bearing portions 51. The frame body 50 further includes a pair of flange portions 52. Specifically, the frame body 50 includes a pair of sidewalls 50*a* facing each other in the width direction D1. The pair of bearing portions 51 and the pair of flange portions 52 respectively protrude from the pair of sidewalls 50*a*.

The pair of bearing portions 51 protrude outward from the pair of sidewalls 50*a* in the width direction D1. The pair of bearing portions 51 support both ends of the rotation shaft 32*x* of the feed roller 32 such that the rotation shaft 32*x* can rotate.

A specific bearing portion 510, which is one of the pair of bearing portions 51, has a through-hole 51*a* passing therethrough in the width direction D1 (see FIG. 5). A first end of the rotation shaft 32*x* is fitted in the through-hole 51*a* in the specific bearing portion 510.

The pair of flange portions 52 protrude outward from the pair of sidewalls 50*a* in the width direction D1 and extend in the crossing direction D2 (see FIGS. 4 and 5).

The roller unit 5 is further provided with a rotation transmission mechanism 53 and a biasing mechanism 54 (see FIG. 4).

The rotation transmission mechanism 53 transmits the rotational force of the feed roller 32 to the pickup roller 31. For example, the rotation transmission mechanism 53 is a gear mechanism. The rotation transmission mechanism 53 may be a mechanism that transmits the rotational force using an endless belt.

The biasing mechanism 54 biases the pickup roller 31 toward the top surface of the sheet placed on the sheet placement portion 20. In the present embodiment, the biasing mechanism 54 includes a spring 54*a* disposed between part of the mounting portion 6 and the top surface of the sheet placed on the sheet placement portion 20.

The biasing mechanism 54 biases the frame body 50 downward using the elastic force of the spring 54*a*. Thus, the biasing mechanism 54 biases the pickup roller 31 toward the top surface of the sheet on the sheet placement portion 20.

The mounting portion 6 is provided with a base member 61, a pair of bearing support members 62, and a biasing mechanism 65. The base member 61 is secured inside the main body 1. For example, the base member 61 is formed from synthetic resin.

Figure 6:
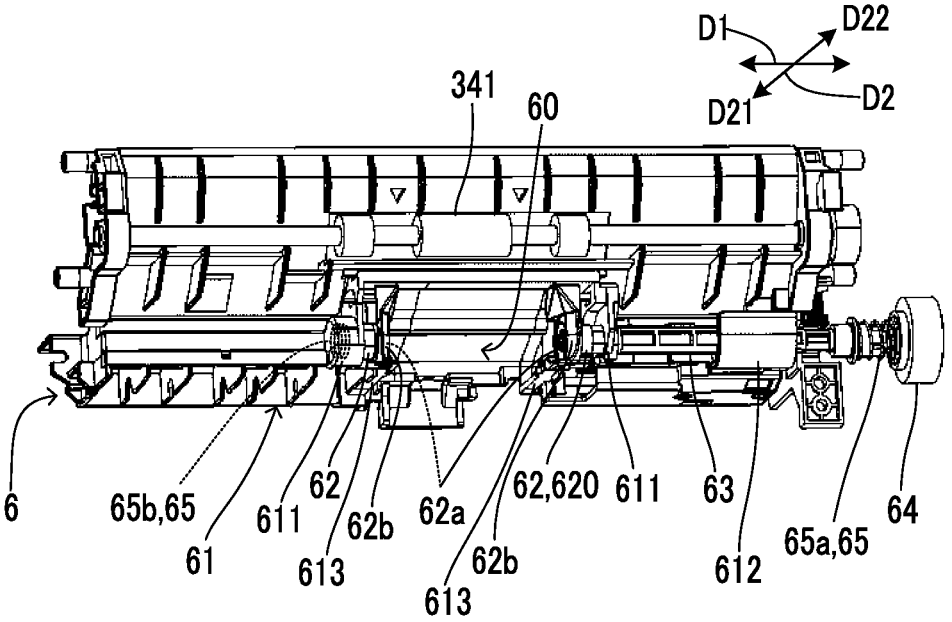
FIG. 6 is a perspective view of the mounting portion and the periphery of the mounting portion in the sheet conveying device according to the first embodiment.
Figure 7:
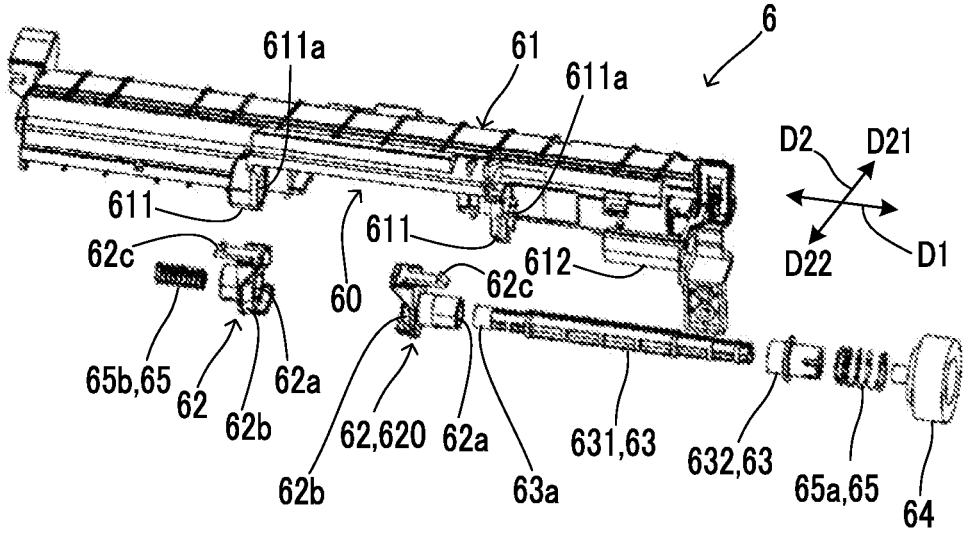
FIG. 7 is an exploded perspective view of the mounting portion in the sheet conveying device according to the first embodiment.

The base member 61 includes a pair of opposing walls 611 (see FIGS. 6 and 7). The pair of opposing walls 611 face each other in the width direction D1 with a mounting space 60 therebetween. The mounting space 60 receives the roller unit 5.

The pair of opposing walls 611 support the pair of bearing support members 62 such that the pair of bearing support members 62 can move in the width direction D1. The pair of bearing support members 62 are disposed to face each other in the width direction D1 with the mounting space 60 therebetween. The pair of opposing walls 611 each have an attachment hole 611*a*. The pair of bearing support members 62 are fitted in the attachment holes 611*a* in the pair of opposing walls 611.

Figure 8:
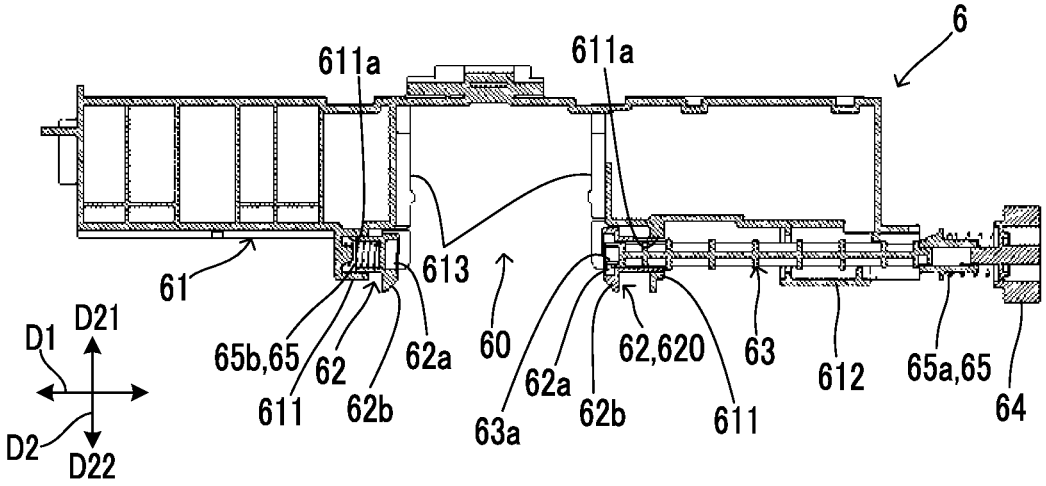
FIG. 8 shows a horizontal cross section of the mounting portion in the sheet conveying device according to the first embodiment.
Figure 9:
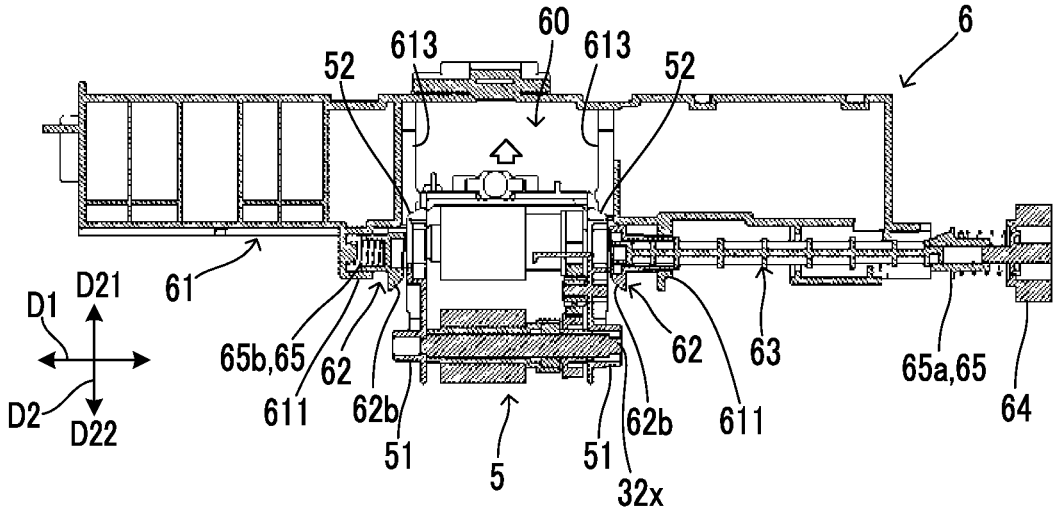
FIG. 9 shows a horizontal cross section of the roller unit and the mounting portion in the sheet conveying device according to the first embodiment (when the mounting of the roller unit has started).

The pair of bearing support members 62 are supported to be movable outward from respective predetermined support positions in the width direction D1. FIGS. 8 and 9 show a state where the pair of bearing support members 62 are located at the support positions.

The pair of bearing support members 62 face each other in the width direction D1 with the mounting space 60 therebetween. The pair of bearing support members 62 are supported by the pair of opposing walls 611 to be movable between the support positions and retraction positions. The support positions are located inside the pair of opposing walls 611 along the width direction D1. When located at the support positions, the pair of bearing support members 62 can support the pair of bearing portions 51.

When located at the retraction positions, the pair of bearing support members 62 face each other with a space into which the pair of bearing portions 51 can be inserted therebetween. In other words, when located at the retraction positions, the pair of bearing support members 62 can release the pair of bearing portions 51.

The bearing support members 62 each include a locking portion 62*c* (see FIG. 7). The locking portions 62*c* are caught in part of the base member 61 to restrict the bearing support members 62 from moving inward in the width direction D1 beyond the support positions.

The bearing support members 62 each have a hole 62*a* and a guide surface 62*b* (see FIGS. 6 to 8). That is, the pair of bearing support members 62 have the pair of holes 62*a* and the pair of guide surfaces 62*b*. The bearing portions 51 of the roller unit 5 are inserted into the holes 62*a* in the respective bearing support members 62. Thus, the pair of bearing support members 62 support the pair of bearing portions 51.

The roller unit 5 is supported by the pair of bearing support members 62 to be swingable vertically.

One of the pair of bearing support members 62 is a specific support member 620 that supports the specific bearing portion 510 (see FIGS. 6 to 8). The hole 62*a* in the specific support member 620 is a through-hole that passes through the specific support member 620 in the width direction D1.

The pair of guide surfaces 62*b* adjoin the pair of holes 62*a* in the crossing direction D2 (see FIGS. 6 to 8). Specifically, the pair of guide surfaces 62*b* are located on sides of the pair of holes 62*a* facing the removal direction D22.

The pair of guide surfaces 62*b* are surfaces facing the roller unit 5 when the roller unit 5 is mounted in the mounting portion 6 in the mounting direction D21. The pair of guide surfaces 62*b* are inclined with respect to the crossing direction D2. The pair of guide surfaces 62*b* are inclined such that the space formed therebetween along the width direction D1 gradually decreases in the mounting direction D21 (see FIG. 8). In other words, the pair of guide surfaces 62*b* are inclined inward along the width direction D1 in the mounting direction D21.

The biasing mechanism 65 biases the pair of bearing support members 62 toward the support positions. In the present embodiment, the biasing mechanism 65 includes a first spring 65*a* and a second spring 65*b* (see FIGS. 6 to 8). The first spring 65*a* and the second spring 65*b* bias the pair of bearing support members 62 inward in the width direction D1. The first spring 65*a* and the second spring 65*b* are an example of a pair of biasing members.

The first spring 65*a* biases the specific support member 620, which is the one of the pair of bearing support members 62, toward its support position. The second spring 65*b* biases the other one of the pair of bearing support members 62 toward its support position.

The mounting portion 6 is further provided with a drive shaft 63, a drive gear 64, and a slide support portion 612 (see FIGS. 6 to 8). The base member 61 includes the slide support portion 612.

The drive shaft 63 engages with the first end of the rotation shaft 32*x* of the feed roller 32. The drive shaft 63 rotates upon receiving an external force and transmits the rotational force to the rotation shaft 32*x*.

In the example shown in FIG. 7, the drive shaft 63 is composed of a combination of a shaft member 631 and a coupling member 632. One end of the shaft member 631, or an engagement portion 63*a*, engages with the first end of the rotation shaft 32*x* of the feed roller 32. The coupling member 632 is assembled in the other end of the shaft member 631.

The engagement portion 63*a* of the drive shaft 63 is fitted in the hole 62*a* in the specific support member 620. The engagement portion 63*a* engages with the first end of the rotation shaft 32*x* of the feed roller 32 inside the hole 62*a* in the specific support member 620.

The first spring 65*a* biases the coupling member 632 inward in the width direction D1. The coupling member 632 is connected to the drive gear 64. The rotational force of the drive gear 64 is transmitted to the shaft member 631 through the coupling member 632.

The drive shaft 63 may be composed of one member including portions each corresponding to the shaft member 631 and the coupling member 632.

The slide support portion 612 supports the drive shaft 63 such that the drive shaft 63 can move in the width direction D1. The drive shaft 63 is supported to be movable in the width direction D1 integrally with the specific support member 620. That is, the drive shaft 63 is movable in the width direction D1 integrally with the specific support member 620.

The first spring 65*a* biases the drive shaft 63 in the width direction D1 toward the mounting space 60. Thus, the first spring 65*a* biases the specific support member 620 toward the support position through the drive shaft 63.

The drive gear 64 is connected to the end of the drive shaft 63 on the outer side along the width direction D1. In the present embodiment, the coupling member 632 is the end of the drive shaft 63 on the outer side along the width direction D1. The drive gear 64 rotates by being driven by a motor and a gear mechanism (both not shown).

The drive shaft 63 rotates as the drive gear 64 rotates. Thus, the drive shaft 63 transmits the rotational force to the rotation shaft 32*x* of the feed roller 32.

Mounting of Roller Unit 5

The following describes actions of components of the roller unit 5 and the mounting portion 6 when the roller unit 5 is mounted in the mounting portion 6.

Figure 10:
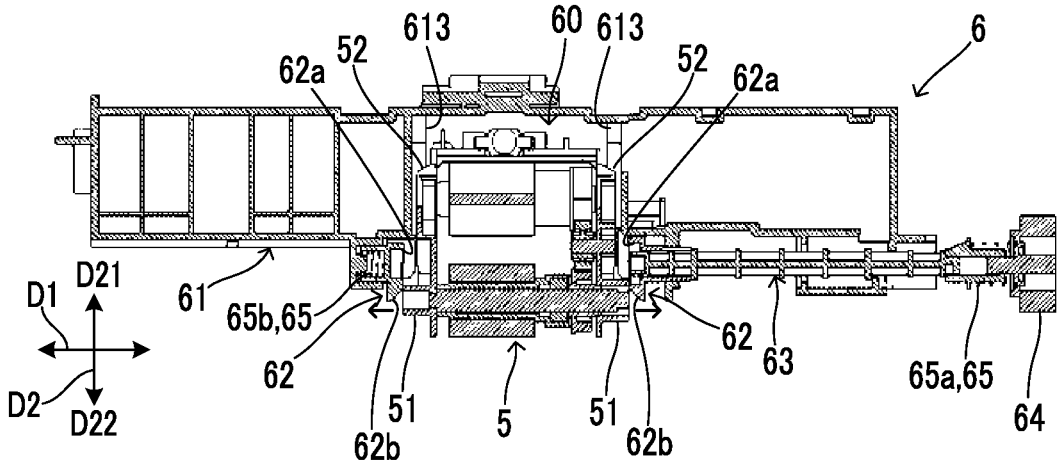
FIG. 10 shows a horizontal cross section of the roller unit and the mounting portion in the sheet conveying device according to the first embodiment (before the mounting of the roller unit finishes).

As shown in FIGS. 9 and 10, the roller unit 5 is brought closer to the main body 1 in the crossing direction D2 to be inserted into the mounting space 60.

The base member 61 further includes a pair of guide support portions 613 (see FIGS. 6 and 8 to 10). The pair of guide support portions 613 face each other in the width direction D1 with the mounting space 60 therebetween and extend in the crossing direction D2.

The pair of guide support portions 613 support the pair of flange portions 52 of the roller unit 5. When the roller unit 5 is inserted into the mounting space 60 in the mounting direction D21, the pair of flange portions 52 slide on the pair of guide support portions 613. Thus, the pair of bearing portions 51 of the roller unit 5 are guided to the pair of guide surfaces 62*b* of the pair of bearing support members 62 (see FIG. 9).

In addition, when the roller unit 5 is inserted into the mounting space 60 in the mounting direction D21, the pair of bearing portions 51 abut on the pair of guide surfaces 62*b* and move the pair of bearing support members 62 from the support positions to the retraction positions (see FIG. 10).

Furthermore, the pair of guide surfaces 62*b* guide the pair of bearing portions 51 to the holes 62*a* in the pair of bearing support members 62. Thus, the roller unit 5 is guided to the mounting space 60. When the pair of bearing portions 51 pass through the pair of guide surfaces 62*b*, the pair of bearing support members 62 move inward in the width direction D1 by the action of the biasing mechanism 65 (see FIG. 11).

Figure 11:
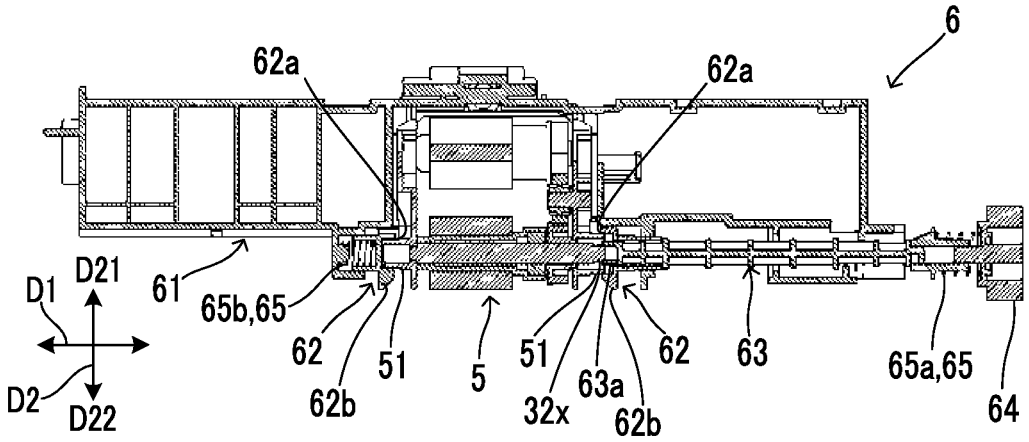
FIG. 11 shows a horizontal cross section of the roller unit and the mounting portion in the sheet conveying device according to the first embodiment (when the roller unit is mounted).

The pair of bearing support members 62 move inward in the width direction D1 and thereby cause the pair of bearing portions 51 to be inserted into the holes 62*a* in the pair of bearing support members 62 (see FIG. 11). Thus, the roller unit 5 is swingably supported by the pair of bearing support members 62.

That is, after moving to the retraction positions, the pair of bearing support members 62 move back from the retraction positions to the support positions by the biasing force of the biasing mechanism 65 and support the pair of bearing portions 51.

This completes the mounting of the roller unit 5 in the mounting portion 6.

As described above, the mounting of the roller unit 5 involves only moving the roller unit 5 in the mounting direction D21. In this case, the users can mount the roller unit 5 in the mounting portion 6 of the main body 1 with intuitive simple operation.

The removal of the roller unit 5 from the main body 1 may involve moving the roller unit 5 in multiple directions. In this case, the users need to understand the procedure of moving the roller unit 5 in multiple directions in advance by, for example, reading user manuals.

The removal is desirably as simple as possible. For example, the removal may be an operation of only moving a predetermined member in a direction toward the main body 1 and in a direction away from the main body 1. In this case, the users can remove the roller unit 5 from the main body 1 with intuitive operation.

The sheet conveying device 3 has a configuration that allows the roller unit 5 to be removed from the main body 1 with operations as simple as possible. The following describes the configuration thereof.

Figure 12:
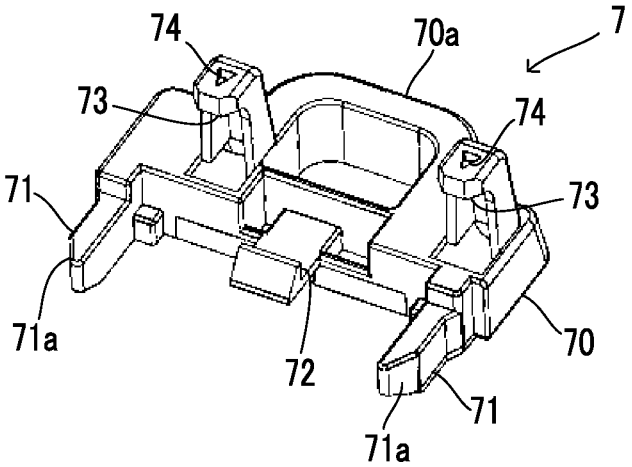
FIG. 12 is a perspective view of an auxiliary tool serving as an attachment provided for the sheet conveying device according to the first embodiment.

The sheet conveying device 3 is further provided with an auxiliary tool 7 (see FIG. 12). The auxiliary tool 7 is a component separate from the mounting portion 6 and the roller unit 5. The auxiliary tool 7 is used to remove the roller unit 5.

For example, the auxiliary tool 7 is housed in an empty space inside the main body 1 or the sheet storing portion 2 when not in use.

Figure 3:
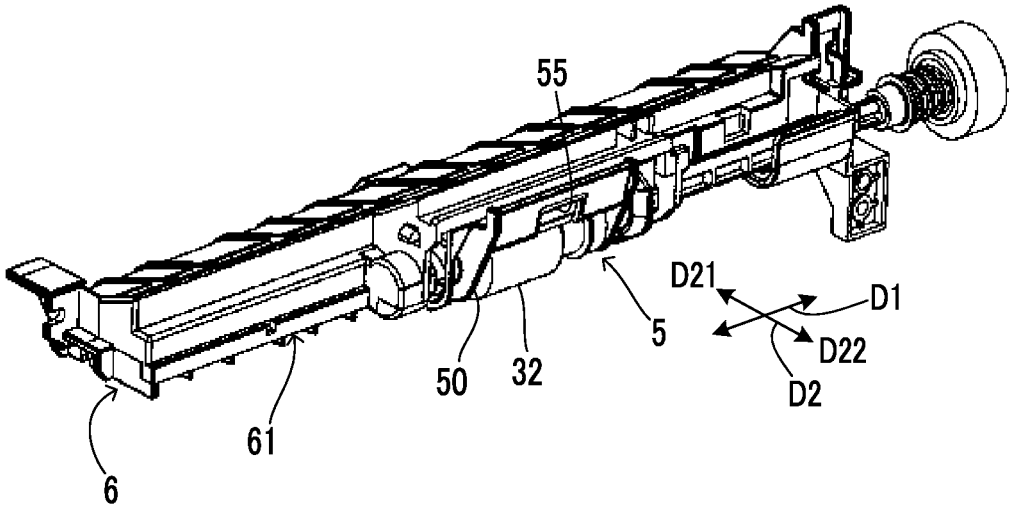
FIG. 3 is a perspective view of a roller unit and a mounting portion in the sheet conveying device according to the first embodiment.

In addition, the frame body 50 of the roller unit 5 includes a first engagement portion 55 that is engageable with a part of the auxiliary tool 7 (see FIGS. 3 and 5). In the present embodiment, the first engagement portion 55 is an opening created in the frame body 50.

The auxiliary tool 7 includes a base portion 70, a pair of arm portions 71, and a second engagement portion 72 (see FIG. 12). The base portion 70 includes a handle portion 70*a* that can be held by fingers. The auxiliary tool 7 is used to remove the roller unit 5 by being held by the handle portion 70*a*.

The pair of arm portions 71 extend from the base portion 70. The pair of arm portions 71 are disposed in parallel with a space corresponding to the space between the pair of bearing support members 62 therebetween. The second engagement portion 72 is engageable with the first engagement portion 55 of the roller unit 5.

The second engagement portion 72 is formed in the base portion 70 between the pair of arm portions 71. The handle portion 70*a* is formed in the base portion 70 on a side opposite the side on which the pair of arm portions 71 extend.

In the present embodiment, the auxiliary tool 7 further includes one or more hook portions 73 extending from the base portion 70. For example, the auxiliary tool 7 includes two hook portions 73. The hook portions 73 can be hooked on the rotation shaft 341*x* of the first lead-in roller 341 (see FIG. 14).

The rotation shaft 341*x* of the first lead-in roller 341 is an example of an auxiliary support portion on which a part of the auxiliary tool 7 is hooked. The rotation shaft 341*x* of the first lead-in roller 341 is disposed in the main body 1 above the mounting portion 6.

In addition, the sheet conveying device 3 is provided with target portions 66. The target portions 66 are provided for the main body 1 and have first marks 67 placed thereon. In the present embodiment, the target portions 66 are parts of members that guide the sheets conveyed by the pair of lead-in rollers 340.

The hook portions 73 of the auxiliary tool 7 have second marks 74 placed thereon. The second marks 74 correspond to the first marks 67 (see FIG. 12). The hook portions 73 are an example of positioning portions having the second marks 74 placed thereon.

Figure 13:
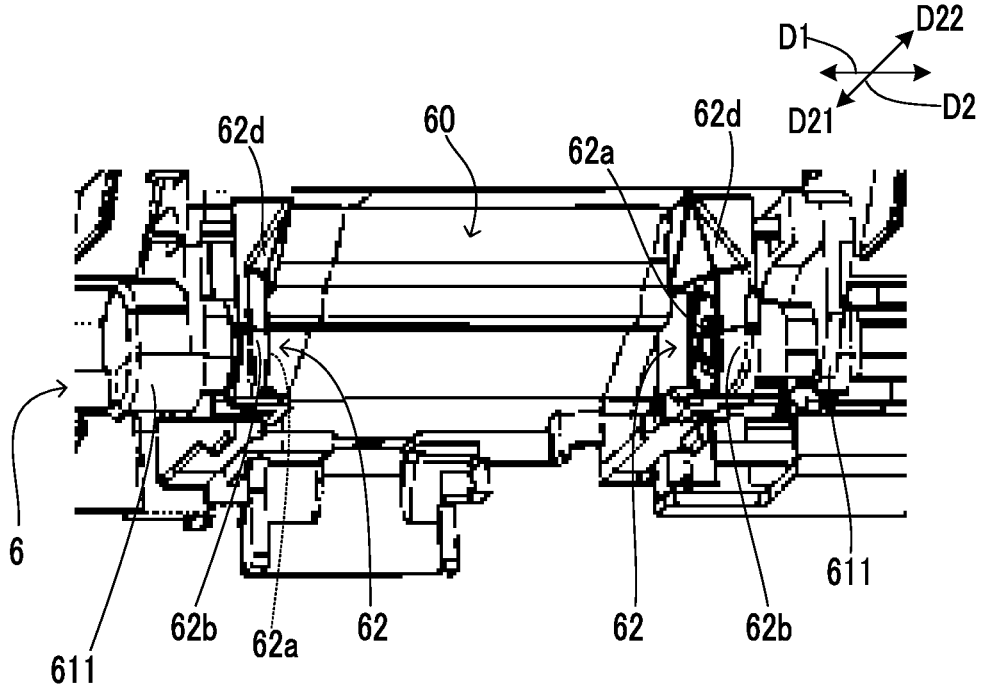
FIG. 13 is a perspective view of a key part of the mounting portion in the sheet conveying device according to the first embodiment.

As shown in FIG. 13, the pair of bearing support members 62 have a pair of inclined surfaces 62*d* inclined with respect to the crossing direction D2. In the present embodiment, the pair of inclined surfaces 62*d* are located over the holes 62*a* to adjoin the holes 62*a*. The pair of inclined surfaces 62*d* are inclined such that the space formed therebetween along the width direction D1 gradually decreases in the mounting direction D21. In other words, the pair of inclined surfaces 62*d* are inclined inward along the width direction D1 in the mounting direction D21.

Removal of Roller Unit 5

The following describes actions of the auxiliary tool 7, the roller unit 5, and the mounting portion 6 when the roller unit 5 is removed from the mounting portion 6.

Figure 14:
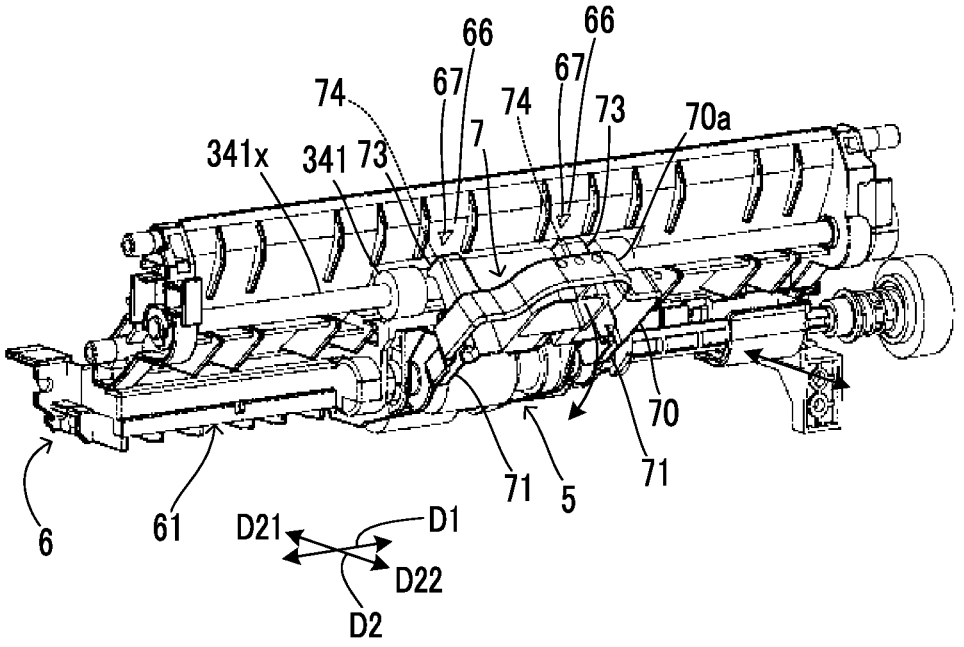
FIG. 14 is a perspective view of the roller unit and the mounting portion in the sheet conveying device according to the first embodiment (before the auxiliary tool is pushed toward the mounting portion).

First, the second marks 74 on the auxiliary tool 7 are disposed at positions corresponding to the first marks 67 on the target portions 66 (see FIG. 14). This causes the hook portions 73 of the auxiliary tool 7 to be hooked on the rotation shaft 341*x* of the first lead-in roller 341.

When the hook portions 73 is hooked on the rotation shaft 341*x*, the auxiliary tool 7 is swingably supported by the rotation shaft 341*x*. At this moment, the auxiliary tool 7 swings on the rotation shaft 341*x*.

The distal ends of the pair of arm portions 71 of the auxiliary tool 7 are brought into contact with the pair of inclined surfaces 62*d* with the hook portions 73 of the auxiliary tool 7 hooked on the rotation shaft 341*x*. The state where the hook portions 73 are hooked on the rotation shaft 341*x* corresponds to a state where the auxiliary tool 7 is supported by the rotation shaft 341*x* through the hook portions 73.

Figure 15:
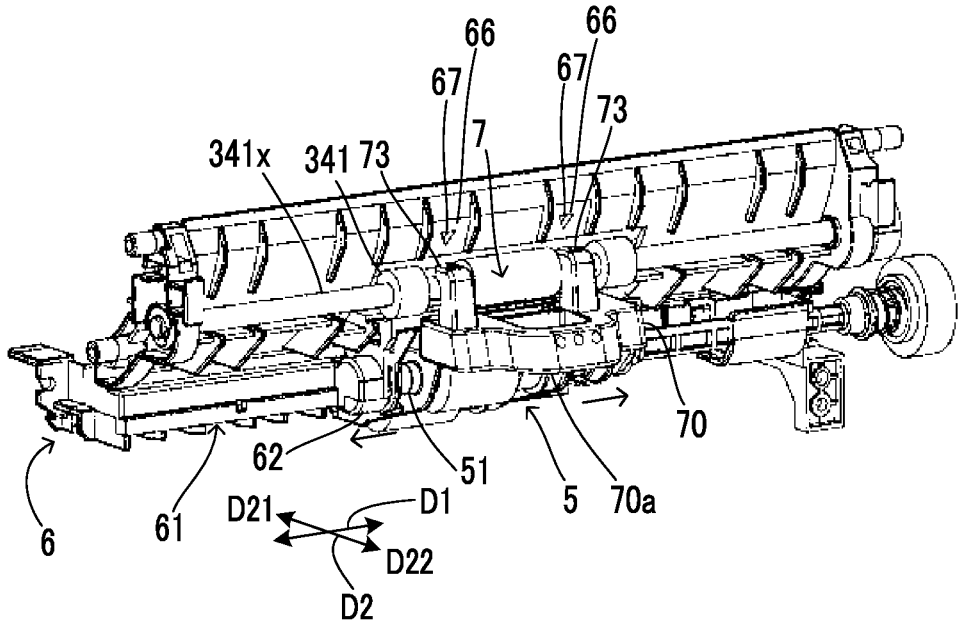
FIG. 15 is a perspective view of the roller unit and the mounting portion in the sheet conveying device according to the first embodiment (when the auxiliary tool is pushed toward the mounting portion).

The base portion 70 is pushed toward the mounting portion 6 with the hook portions 73 of the auxiliary tool 7 hooked on the rotation shaft 341*x* (see FIG. 15). That is, the base portion 70 of the auxiliary tool 7 is moved toward the mounting portion 6 with the second marks 74 located at the positions corresponding to the first marks 67. This causes the base portion 70 to swing toward the mounting portion 6.

When the base portion 70 is pushed toward the mounting portion 6, the distal ends of the pair of arm portions 71 move the pair of bearing support members 62 outward in the width direction D1 while sliding on the pair of inclined surfaces 62*d* of the pair of bearing support members 62 (see FIG. 15).

When the base portion 70 is pushed toward the mounting portion 6, the pair of arm portions 71 move the pair of bearing support members 62 outward in the width direction D1 until the pair of bearing portions 51 of the roller unit 5 become detached from the holes 62*a* in the pair of bearing support members 62. FIG. 15 shows a state where the pair of bearing portions 51 are detached from the holes 62*a* in the pair of bearing support members 62.

That is, as the pair of arm portions 71 move the pair of bearing support members 62, the pair of bearing portions 51 become detached from the holes 62*a* in the pair of bearing support members 62.

As described above, the auxiliary tool 7 is brought closer to the mounting portion 6 in the crossing direction D2 with the roller unit 5 mounted in the mounting portion 6. This causes the auxiliary tool 7 to be engaged with the roller unit 5. When the auxiliary tool 7 is brought closer to the mounting portion 6 in the crossing direction D2, the pair of arm portions 71 abut on the pair of bearing support members 62 and move the pair of bearing support members 62 from the support positions to the retraction positions.

In the present embodiment, the auxiliary tool 7 is moved toward the mounting portion 6 with the auxiliary tool 7 supported by the rotation shaft 341*x* through the hook portions 73. When the auxiliary tool 7 is moved toward the mounting portion 6, the pair of arm portions 71 abut on the pair of bearing support members 62 and move the pair of bearing support members 62 from the support positions to the retraction positions.

Furthermore, when the pair of bearing portions 51 become detached from the holes 62*a* in the pair of bearing support members 62, the second engagement portion 72 of the auxiliary tool 7 engages with the first engagement portion 55 of the roller unit 5. That is, the second engagement portion 72 engages with the first engagement portion 55 after the pair of bearing support members 62 move to the retraction positions.

Figure 16:
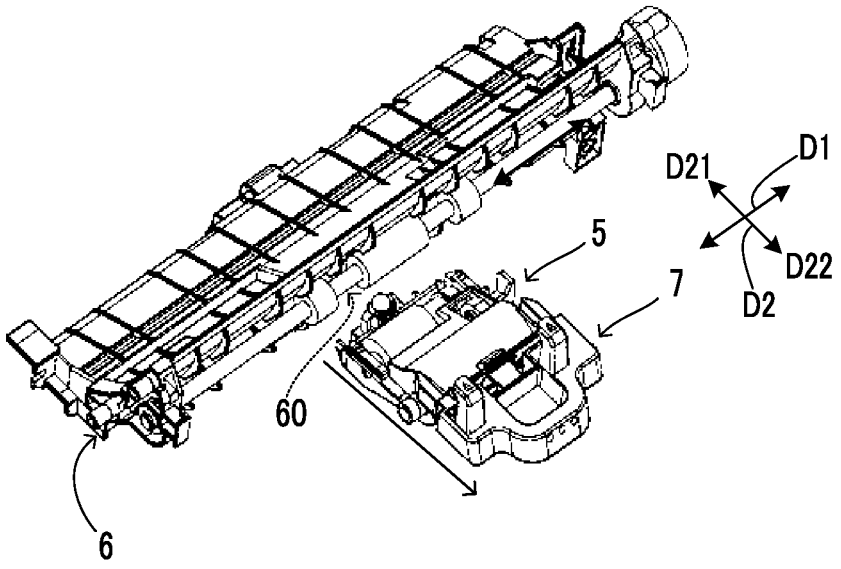
FIG. 16 is a perspective view of the roller unit, the mounting portion, and the auxiliary tool in the sheet conveying device according to the first embodiment (when the roller unit is pulled out of a mounting space together with the auxiliary tool).

The auxiliary tool 7 is separated from the mounting portion 6 in the crossing direction D2 with the second engagement portion 72 engaging with the first engagement portion 55 (see FIG. 16). That is, while the second engagement portion 72 engages with the first engagement portion 55, the base portion 70 of the auxiliary tool 7 is pulled in the removal direction D22. This causes the auxiliary tool 7 to be separated from the mounting portion 6 in the removal direction D22.

As the auxiliary tool 7 is separated from the mounting portion 6, the roller unit 5 is pulled out of the mounting space 60 integrally with the auxiliary tool 7 (see FIG. 16). That is, the roller unit 5 is separated from the mounting portion 6 together with the auxiliary tool 7 because the second engagement portion 72 engages with the first engagement portion 55.

In addition, when the roller unit 5 is pulled out of the mounting space 60, the pair of flange portions 52 slide on the pair of guide support portions 613. This reduces the load applied by the roller unit 5 on the auxiliary tool 7.

As described above, the removal of the roller unit 5 from the mounting portion 6 is a very simple operation of only moving the auxiliary tool 7 in the direction toward the main body 1 and in the direction away from the main body 1. Accordingly, the users can remove the roller unit 5 from the main body 1 with intuitive operation.

Second Embodiment

Next, a sheet conveying device 3A according to a second embodiment will be described with reference to FIGS. 17 to 20. The sheet conveying device 3A may be applied to the image forming apparatus 10 instead of the sheet conveying device 3.

In FIGS. 17 to 20, the same reference numbers and symbols are used for components that are identical to those shown in FIGS. 1 to 16. The following describes features of the sheet conveying device 3A different from those of the sheet conveying device 3.

Figure 17:
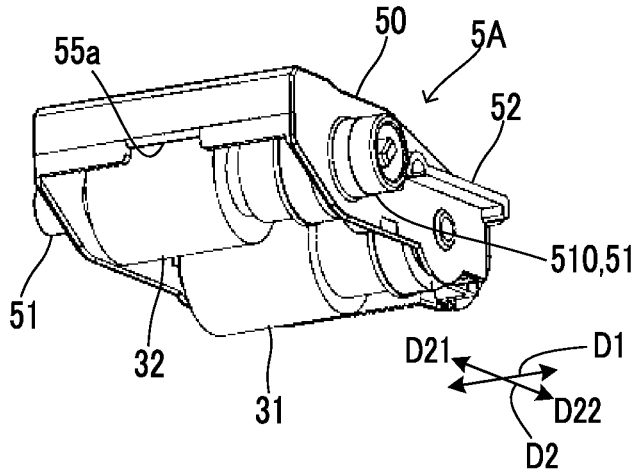
FIG. 17 is a perspective view of a roller unit in a sheet conveying device according to a second embodiment.
Figure 18:
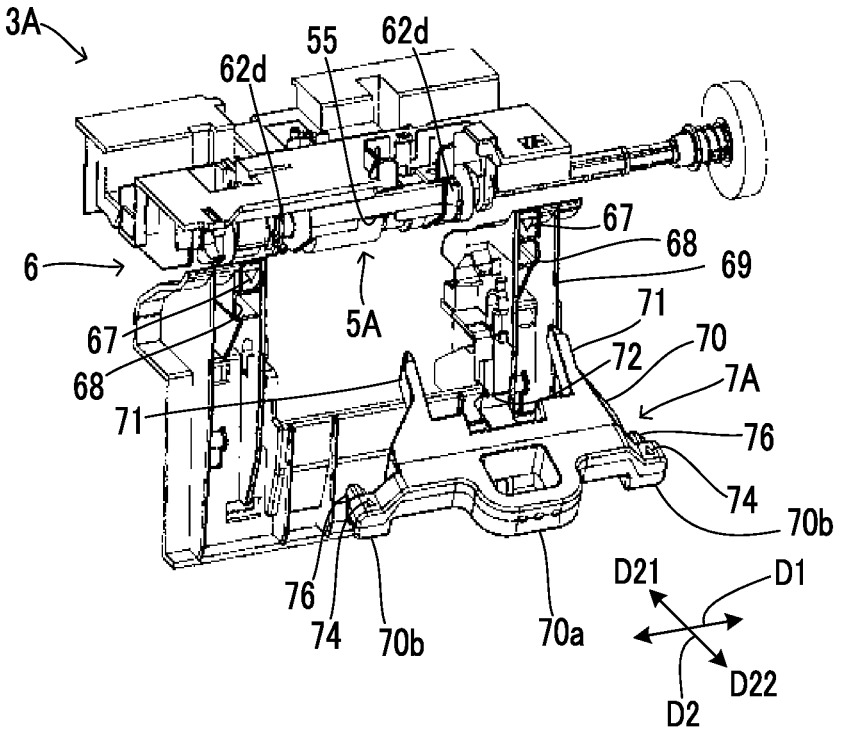
FIG. 18 is a perspective view of the roller unit, a mounting portion, and an auxiliary tool in the sheet conveying device according to the second embodiment (before the auxiliary tool is pushed toward the mounting portion).

The sheet conveying device 3A is provided with a roller unit 5A and an auxiliary tool 7A instead of the roller unit 5 and the auxiliary tool 7, respectively (see FIGS. 17 and 18).

The roller unit 5A has a configuration in which the first engagement portion 55 in the roller unit 5 is replaced with a first engagement portion 55*a* (see FIG. 17). The first engagement portion 55*a* is a recess created in the edge of the frame body 50. The first engagement portion 55*a* is engageable with the second engagement portion 72 of the auxiliary tool 7A.

The sheet conveying device 3A includes multiple recesses 68 provided for the main body 1 (see FIG. 18). In the example shown in FIG. 18, the sheet conveying device 3A includes a pair of recesses 68. The pair of recesses 68 are open in the removal direction D22.

The pair of recesses 68 are formed in a frame member 69 provided for the main body 1. In addition, the frame member 69 has a pair of first marks 67 indicating the pair of recesses 68 placed thereon. The parts of the frame member 69 with the first marks 67 placed thereon are an example of a target portion.

The auxiliary tool 7A includes multiple protrusions 76 provided for the base portion 70 instead of the hook portions 73. In the example shown in FIG. 18, the auxiliary tool 7A includes a pair of protrusions 76. The pair of protrusions 76 correspond to the pair of recesses 68.

The pair of protrusions 76 protrude from the base portion 70 in the same direction as the pair of arm portions 71. The pair of protrusions 76 can be fitted in the pair of recesses 68.

In the present embodiment, the base portion 70 includes a pair of projecting portions 70*b* that project outward from both sides (see FIG. 18). The pair of protrusions 76 protrude from the pair of projecting portions 70*b*.

In the auxiliary tool 7A, a pair of second marks 74 are respectively placed on the pair of projecting portions 70*b*. In the auxiliary tool 7A, the pair of projecting portions 70*b* are an example of the positioning portions.

When the roller unit 5A is removed, the second marks 74 on the auxiliary tool 7A are placed at positions corresponding to the first marks 67. Thus, the pair of protrusions 76 face the pair of recesses 68.

Figure 19:
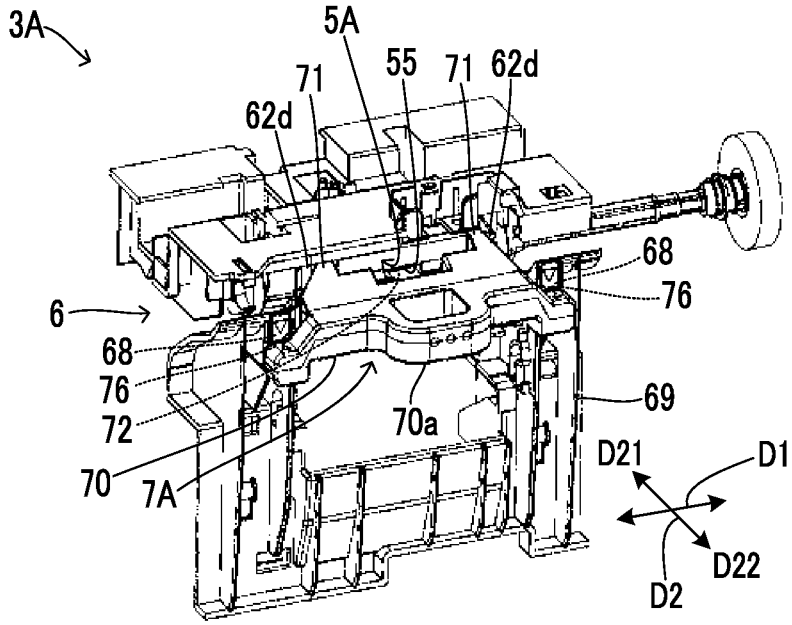
FIG. 19 is a perspective view of the roller unit, the mounting portion, and the auxiliary tool in the sheet conveying device according to the second embodiment (when the auxiliary tool is pushed toward the mounting portion).

When the base portion 70 is pushed toward the mounting portion 6 with the second marks 74 located at the positions corresponding to the first marks 67, the pair of protrusions 76 of the auxiliary tool 7A are fitted into the pair of recesses 68 (see FIG. 19). That is, the auxiliary tool 7A engages with the roller unit 5 such that the second marks 74 align with the first marks 67.

When the pair of protrusions 76 of the auxiliary tool 7A are fitted into the pair of recesses 68, the distal ends of the pair of arm portions 71 of the auxiliary tool 7A move the pair of bearing support members 62 outward in the width direction D1 while sliding on the inclined surfaces 62*d* of the pair of bearing support members 62. Thus, the pair of bearing portions 51 of the roller unit 5A become detached from the holes 62*a* in the pair of bearing support members 62.

FIG. 19 shows a state where the pair of bearing portions 51 are detached from the holes 62*a* in the pair of bearing support members 62.

That is, as the pair of arm portions 71 move the pair of bearing support members 62, the pair of bearing portions 51 become detached from the holes 62*a* in the pair of bearing support members 62. When the pair of bearing portions 51 become detached from the holes 62*a* in the pair of bearing support members 62, the second engagement portion 72 of the auxiliary tool 7A engages with the first engagement portion 55*a* of the roller unit 5A.

Figure 20:
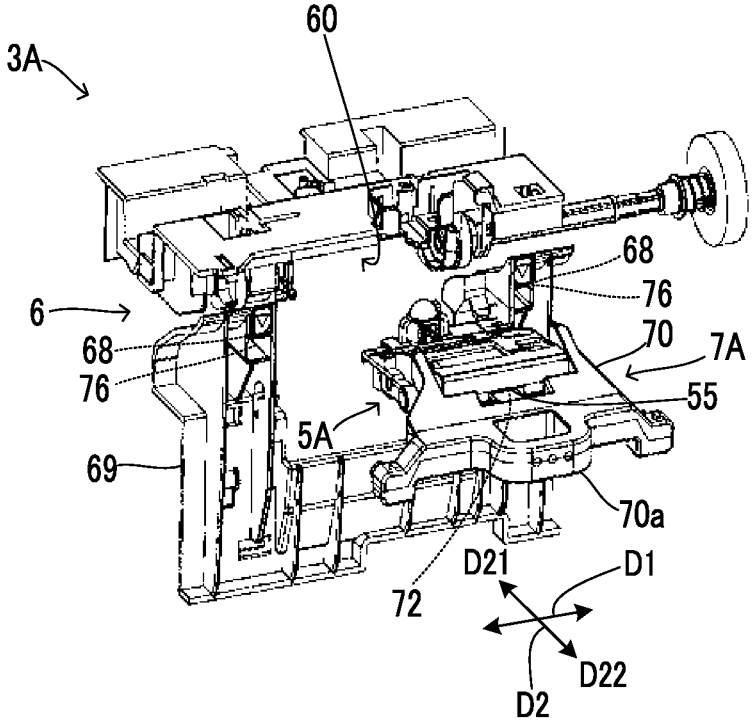
FIG. 20 is a perspective view of the roller unit, the mounting portion, and the auxiliary tool in the sheet conveying device according to the second embodiment (when the roller unit is pulled out of the mounting space together with the auxiliary tool).

While the second engagement portion 72 engages with the first engagement portion 55*a*, the auxiliary tool 7A is separated from the mounting portion 6 (see FIG. 20). That is, while the second engagement portion 72 engages with the first engagement portion 55*a*, the base portion 70 of the auxiliary tool 7A is pulled in the removal direction D22.

As the auxiliary tool 7A is separated from the mounting portion 6, the roller unit 5A is pulled out of the mounting space 60 (see FIG. 20).

The sheet conveying device 3A also produces effects similar to those produced by the sheet conveying device 3.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a housing;

a sheet feed portion including a mounting portion disposed in the housing and a rotating body unit mountable in the mounting portion and configured to feed a sheet placed on a sheet placement portion to a conveyance path; and an auxiliary tool capable of removing the rotating body unit from the mounting portion by being engaged with the rotating body unit, wherein the rotating body unit includes:

a rotating body with a rotation shaft and a frame body supporting the rotating body, the rotating body unit being mountable in the mounting portion in a mounting direction intersecting a width direction along the rotation shaft, the frame body includes:

a pair of sidewalls facing each other in the width direction;

a pair of bearing portions protruding outward from the pair of sidewalls in the width direction and supporting both ends of the rotation shaft such that the rotation shaft can rotate; and a first engagement portion that is engageable with a part of the auxiliary tool, the mounting portion includes:

a pair of opposing walls facing each other in the width direction;

a mounting space formed between the pair of opposing walls;

a pair of bearing support members supported by the pair of opposing walls to be movable in the width direction; and a pair of biasing members configured to bias the pair of bearing support members inward in the width direction, when located at support positions inside the pair of opposing walls, the pair of bearing support members can support the pair of bearing portions, and when located at retraction positions outside the support positions along the width direction, the pair of bearing support members can release the pair of bearing portions, the auxiliary tool includes:

a base portion;

a pair of arm portions extending parallel to each other from the base portion with a space corresponding to a space between the pair of bearing support members therebetween; and a second engagement portion that is disposed in the base portion between the pair of arm portions and that is engageable with the first engagement portion, when the auxiliary tool is engaged with the rotating body unit mounted in the mounting portion, the pair of arm portions abut on the pair of bearing support members and move the pair of bearing support members from the support positions to the retraction positions, the second engagement portion engages with the first engagement portion after the pair of bearing support members move to the retraction positions, and as the auxiliary tool is separated from the mounting portion with the second engagement portion engaging with the first engagement portion, the rotating body unit is pulled out of the mounting space integrally with the auxiliary tool.

2. The sheet conveying device according to claim 1, wherein the pair of bearing support members include a pair of guide surfaces inclined inward along the width direction and facing the rotating body unit when the rotating body unit is mounted in the mounting portion in the mounting direction, and when the rotating body unit is inserted into the mounting space, the pair of bearing portions abut on the pair of guide surfaces of the pair of bearing support members and move the pair of bearing support members from the support positions to the retraction positions, and then the pair of bearing support members move from the retraction positions to the support positions by a biasing force of the pair of biasing members to support the pair of bearing portions.

3. The sheet conveying device according to claim 1, further comprising:

an auxiliary support portion disposed upstream of the mounting portion in the mounting direction and configured to support the auxiliary tool temporarily by a part of the auxiliary tool being hooked on the auxiliary support portion, wherein the auxiliary tool includes a hook portion that extends from the base portion in a direction intersecting with the mounting direction and the width direction and that can be hooked on the auxiliary support portion, when the hook portion is hooked on the auxiliary support portion, the auxiliary tool is supported by the auxiliary support portion to be swingable on the auxiliary support portion, and when the base portion is swung toward the mounting portion with the auxiliary tool supported by the auxiliary support portion through the hook portion, the pair of arm portions abut on the pair of bearing support members and move the pair of bearing support members from the support positions to the retraction positions.

4. The sheet conveying device according to claim 1, wherein the mounting portion includes a pair of recesses;

the auxiliary tool includes a pair of protrusions that protrude from the base portion and that can be fitted into the pair of recesses, and in a state where the pair of protrusions are fitted into the pair of recesses, the pair of arm portions abut on the pair of bearing support members and move the pair of bearing support members to the retraction positions.

5. The sheet conveying device according to claim 1, further comprising:

a target portion provided for the housing and including a first mark placed on the target portion, wherein the auxiliary tool includes a positioning portion including a second mark corresponding to the first mark and placed on the auxiliary tool, and the base portion is pushed toward the mounting portion with the second mark located at a position corresponding to the first mark, the pair of arm portions abut on the pair of bearing support members and move the pair of bearing support members to the retraction positions.

6. The sheet conveying device according to claim 1, wherein the auxiliary tool includes a handle portion formed in the base portion on a side opposite a side on which the pair of arm portions extend.

7. The sheet conveying device according to claim 1, wherein the pair of bearing support members have a pair of inclined surfaces inclined with respect to the mounting direction, and when the auxiliary tool is engaged with the rotating body unit mounted in the mounting portion, the pair of arm portions move the pair of bearing support members from the support positions to the retraction positions while sliding on the pair of inclined surfaces of the pair of bearing support members.

8. The sheet conveying device according to claim 1, wherein the sheet feed portion further includes a drive shaft that engages with one end of the rotation shaft of the rotating body and that transmits a rotational force to the rotation shaft, the drive shaft is supported to be movable in the width direction integrally with one of the pair of bearing support members, and one of the pair of biasing members biases the drive shaft in the width direction toward the mounting space and thereby biases the one of the pair of bearing support members toward the support position through the drive shaft.

9. The sheet conveying device according to claim 1, wherein the frame body includes a pair of flange portions protruding from the pair of sidewalls in the width direction and extending in the mounting direction, the mounting portion includes a pair of guide support portions that support the pair of flange portions, and when the rotating body unit is pulled out of the mounting space, the pair of flange portions slide on the pair of guide support portions.

10. An image forming apparatus comprising:

the sheet conveying device according to claim 1; and a printing device configured to form an image on a sheet conveyed by the sheet conveying device.

* * * * *